US009475681B2

(12) United States Patent
Graff

(10) Patent No.: US 9,475,681 B2
(45) Date of Patent: Oct. 25, 2016

(54) APPARATUS AND METHOD FOR TREATING A LOADING-ZONE COVER OF A FILLING MACHINE

(75) Inventor: Helmut Graff, Roxheim (DE)

(73) Assignee: KHS GmbH, Dortmund (DE)

( * ) Notice: Subject to any disclaimer, the term of this patent is extended or adjusted under 35 U.S.C. 154(b) by 402 days.

(21) Appl. No.: 13/979,077

(22) PCT Filed: Nov. 3, 2011

(86) PCT No.: PCT/EP2011/005539
§ 371 (c)(1),
(2), (4) Date: Jul. 10, 2013

(87) PCT Pub. No.: WO2012/097838
PCT Pub. Date: Jul. 26, 2012

(65) Prior Publication Data

US 2013/0284309 A1 Oct. 31, 2013

(30) Foreign Application Priority Data

Jan. 18, 2011 (DE) ..... 10 2011 008 878

(51) Int. Cl.
*B67C 3/26* (2006.01)
*B67C 3/00* (2006.01)

(52) U.S. Cl.
CPC ..... *B67C 3/2642* (2013.01); *B67C 3/005* (2013.01)

(58) Field of Classification Search
CPC ..... B67C 3/001; B67C 3/005; B67C 3/26; B67C 3/2642
USPC ..... 141/1, 11, 85, 86, 87, 88, 89, 90, 91, 141/92, 93, 97
See application file for complete search history.

(56) References Cited

U.S. PATENT DOCUMENTS 2,992,781 A * 7/1961 Howard, Sr. ..... B05B 3/026 134/179
RE25,962 E * 2/1966 Wheaton ..... B65B 55/24 134/81
4,136,719 A * 1/1979 Kronseder ..... B67C 3/001 134/169 C
4,207,932 A * 6/1980 Gilmour ..... B67C 3/005 134/183
4,295,503 A * 10/1981 Gilmour ..... B67C 3/005 134/183
4,337,608 A * 7/1982 Schlosser ..... B67C 3/001 134/80
4,414,036 A * 11/1983 Anderson ..... B67C 3/001 134/166 R
4,501,622 A * 2/1985 Marchadour ..... B08B 3/02 134/18
4,559,961 A * 12/1985 Anderson ..... B67C 3/001 134/166 R
4,582,226 A * 4/1986 Doak ..... B08B 9/0323 137/240
4,623,516 A * 11/1986 Weiler ..... B65B 3/022 137/241

(Continued)

FOREIGN PATENT DOCUMENTS

DE 39 24 188 A1 1/1991
DE 195 42 432 A1 5/1997

(Continued)

*Primary Examiner* — Mark A Laurenzi
*Assistant Examiner* — Andrew Schmid
(74) *Attorney, Agent, or Firm* — Occhiuti & Rohlicek LLP

(57) ABSTRACT

A filling element for a container treatment machine for filling containers with a liquid filling material includes a first channel formed in a filling element housing and forming a dispensing opening for controlled dispensing of filing material into a container, and a second channel formed in or on the housing for delivering a cleaning or disinfecting medium. On an outer face of the housing, a spray nozzle or spray-nozzle assembly connects to the second channel.

24 Claims, 4 Drawing Sheets

(56) References Cited

U.S. PATENT DOCUMENTS 4,642,971 A * 2/1987 Gilkey ..... B26F 3/004 141/89
5,190,084 A * 3/1993 Diehl ..... B67C 3/26 141/286
5,348,058 A * 9/1994 Ruhl ..... B67C 3/001 134/169 C
5,458,166 A * 10/1995 Kronseder ..... B08B 3/022 134/153
6,035,872 A * 3/2000 Hees ..... B67C 3/001 134/167 R
7,143,793 B2 * 12/2006 Vaughn, Jr. ..... B67C 3/005 134/144
8,096,330 B2 * 1/2012 Mazzon ..... B08B 3/02 141/144
8,349,270 B2 * 1/2013 Winzinger ..... B08B 1/00 134/104.1
8,936,052 B2 * 1/2015 Beisel ..... B67C 3/22 141/144
2010/0269864 A1 * 10/2010 Lohrke ..... B05B 13/0431 134/25.3
2011/0100505 A1 * 5/2011 Jendrichowski ..... B08B 9/34 141/92
2012/0018030 A1 * 1/2012 Laumer ..... B67C 3/001 141/1
2013/0284309 A1 * 10/2013 Graff ..... B67C 3/2642 141/1

FOREIGN PATENT DOCUMENTS

DE 19542432 A1 * 5/1997 ..... B67C 3/001
DE 196 44 399 C1 3/1998
DE 196 43 838 A1 5/1998
EP 0 408 851 A1 1/1991

* cited by examiner

APPARATUS AND METHOD FOR TREATING A LOADING-ZONE COVER OF A FILLING MACHINE

CROSS REFERENCE TO RELATED APPLICATION

This application is the national phase under 35 USC 371 of international application no. PCT/EP2011/005539, filed Nov. 3, 2011, which claims the benefit of the priority date of German application no. 102011008878.4, filed Jan. 18, 2011. The contents of the aforementioned applications are incorporated herein in their entirety.

FIELD OF DISCLOSURE

The invention relates to a filling element of a container treatment machine designed as a filling machine, to a container treatment machine, and to a method for cleaning and/or sterilizing machine elements on container cleaning machines.

BACKGROUND

Container treatment machines, particularly also when configured as filling machines for filling bottles or similar containers with a liquid filling material, are known in various embodiments, especially also of the rotary type having a rotor which can be driven in rotation about a vertical machine axis and on the circumference of which a plurality of container treatment positions are provided, e.g. in the form of filling positions comprising in each case at least one treatment head, for example in the form of a filling element for the controlled dispensing of the liquid filling material into the respective container, and comprising a container carrier for holding the respective container.

Particularly also in the case of filling machines of the rotary type, which can be used for a pressurized filling of the containers and in which the containers, after being handed over to a filling position, are firstly flushed with a suitable inert gas and then are preloaded to a filling pressure over an angle range of the rotational movement of the rotor that forms a loading zone, at least one loading zone cover is provided along said loading zone at the periphery of the rotor in such a way as not to rotate with the latter. This separates the loading zone from the surrounding environment of the filling machine so that splinters or shards of containers that break or burst as they are preloaded to the filling pressure cannot reach the surrounding environment. Furthermore, the loading zone cover also prevents in particular, by means of transverse ribs which are provided on the inner side of the cover facing towards the rotor, any shards from flying from one filling position to adjacent filling positions and thus inter alia also prevents splinters or shards from entering the open containers. To date, it has been extremely difficult to clean such a loading zone cover. This is also true with regard to the removal of product residues which reach the inner face of the loading zone cover for example in the event of a bursting of containers which are at least partially filled with the product, which (product residues) not only contaminate the angled inner faces of the loading zone cover but also cause mould to form after just a short period of time.

SUMMARY

The problem addressed by the invention is that of providing means which enable a simplified cleaning, particularly also an automatic and machine-based cleaning, of such loading zone covers or other machine elements or covers that are provided at the periphery of a rotating rotor and do not move with said rotor.

By virtue of the invention, an automatic and/or machine-based cleaning of machine elements that are arranged at the periphery of the rotor of a container treatment machine is possible, namely via at least one spray nozzle or spray nozzle assembly which is provided on the rotor in such a way as to rotate therewith and via which a preferably liquid cleaning and/or disinfecting medium is delivered in a controlled manner when said at least one spray nozzle or spray nozzle assembly is moving past the machine element, for example the cover or loading zone cover.

In one preferred embodiment of the invention, the at least one spray nozzle or spray nozzle assembly is provided on a filling element or on another treatment head of the container treatment machine. As a result, an automatic and/or machine-based cleaning of the loading zone cover or of another machine element that is provided at the periphery of the rotor is possible even if the container treatment machine is designed in such a way that the treatment heads are provided closely adjacent to on another in a high packing density on the rotor, particularly even container treatment machines in which separating walls or separating panels are provided between the individual treatment positions and hence also between the individual treatment heads on the rotor in order to shield adjacent treatment positions from one another.

In the invention, it is in principle also possible to provide the at least one spray nozzle or spray nozzle assembly between two adjacent treatment heads within the treatment head assembly formed by the treatment heads arranged one after the other on the rotor. In any case, the at least one spray nozzle or spray nozzle assembly is arranged and oriented in such a way that the most optimal possible cleaning of the machine element, for example of the loading zone cover, is achieved on the face facing towards the rotor.

In one particularly advantageous embodiment of the invention, the actuation of the at least one spray nozzle or spray nozzle assembly takes place by means of the machine controller (control computer) of the treatment machine and using in particular also the sensor mechanism which cooperates with this controller and which detects the respective rotary position of the rotor. As a result, it is possible to control the at least one spray nozzle or spray nozzle assembly without additional control complexity so that the delivery of the respective cleaning medium in fact takes place only when the spray nozzle or spray nozzle assembly is located at the region to be cleaned and/or disinfected, i.e. in the so-called spray angle.

Further developments of the invention form the subject matter of the dependent claims.

BRIEF DESCRIPTION OF THE FIGURES

The invention will be explained in more detail below with reference to the figures and on the basis of examples of embodiments. In the figures:

In FIGS. 1 and 2, 1 is a filling machine of the rotary type for filling bottles or similar containers 2 for filling bottles 2 under pressure with a liquid filling material. The filling machine 1 consists substantially of a rotor 3 which can be driven in rotation in the direction of the arrow A about a vertical machine axis MA, on the circumference of which rotor a plurality of filling positions are formed, each having a filling element 4 and a container carrier 5, to which filling positions the empty containers 2 conveyed by an external conveyor 8 are fed via a container inlet 9 and from which the filled containers 2 are removed at a container outlet 10 for forwarding to an external conveyor 11. The ring bowl 12 which is common to all the filling elements 4 is also arranged on the rotor 3 in a known manner.

DETAILED DESCRIPTION

Figure 1:
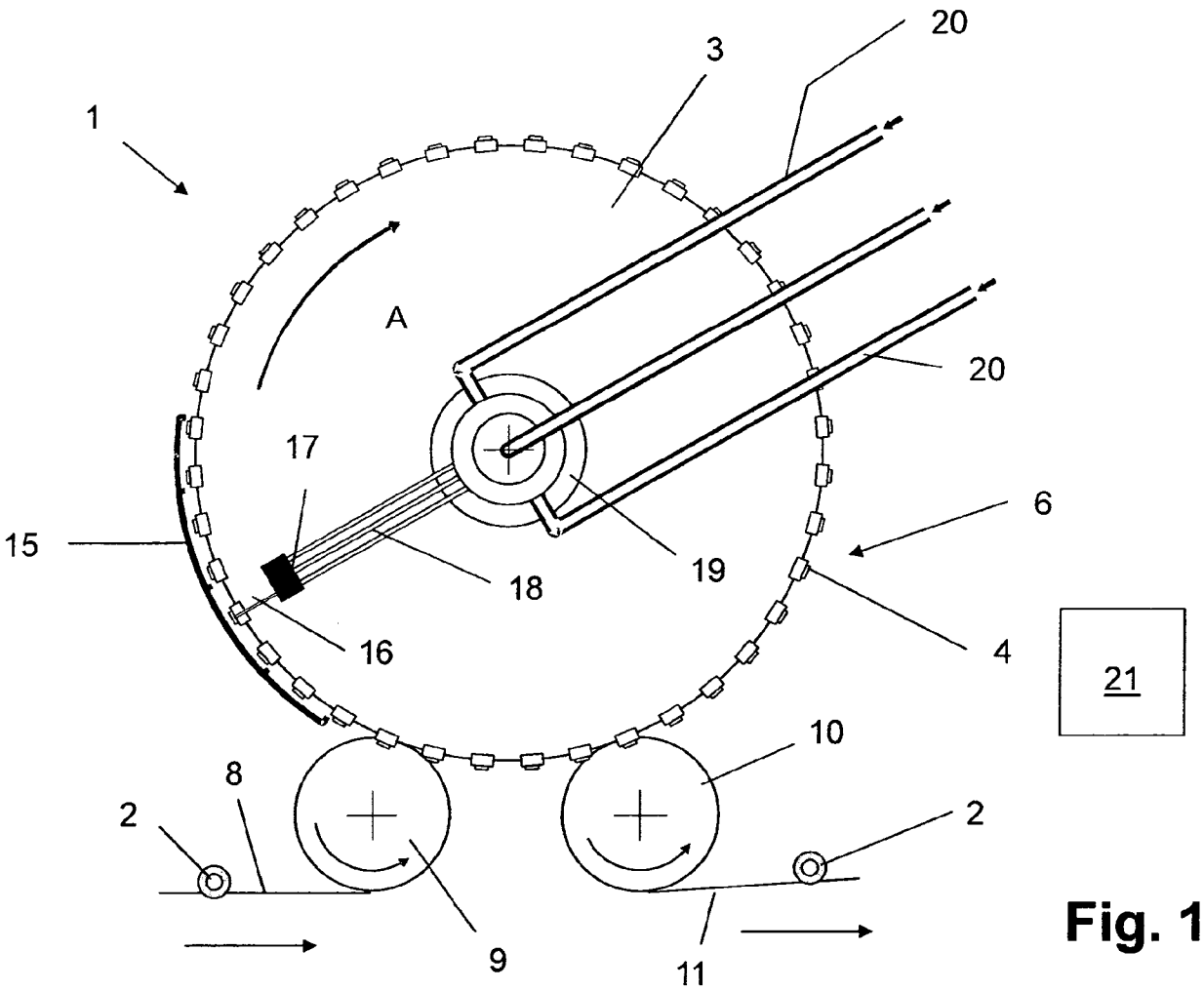
FIG. 1 shows, schematically and in plan view, a filling machine of the rotary type according to the invention.
Figure 2:
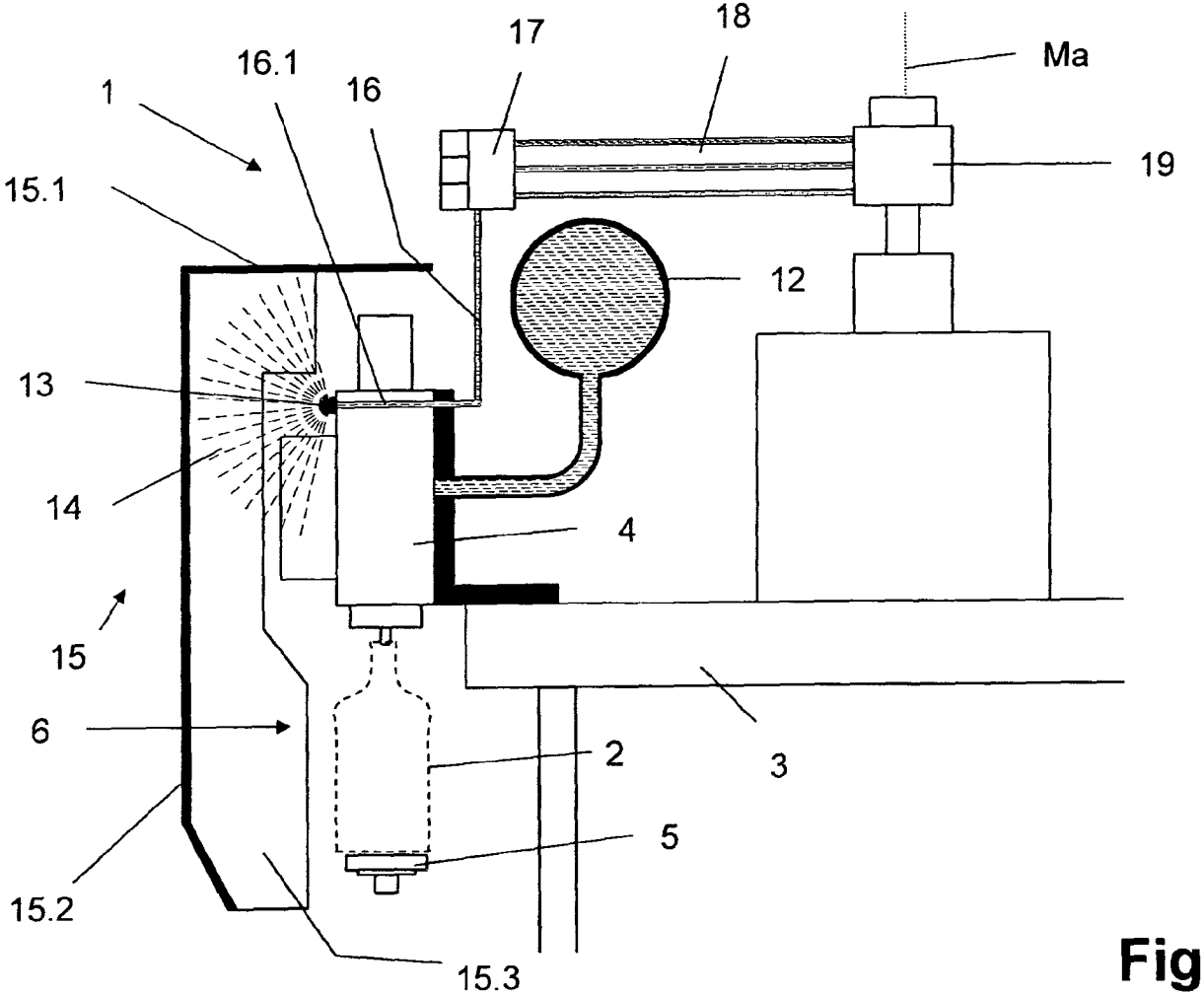
FIG. 2 shows, schematically and on an enlarged scale, a partial view of the rotor of the filling machine of FIG. 1 together with a filling element and a treatment nozzle or spray nozzle for treating a machine element in the form of a loading zone cover.

In a known manner, the filling elements consist inter alia of a housing 4.1 and a liquid channel 4.2 which is formed in said housing and has a dispensing opening for the controlled dispensing of the filling material into the containers 2 during the filling process.

One filling element 4 or a few filling elements 4 are provided with at least one spray nozzle or spray nozzle assembly 13 on their outer side in relation to the vertical machine axis MA, namely for the controlled delivery of cleaning and treatment fluids onto the inner face of machine elements that do not move with the rotor 3, namely in the illustrated embodiment onto the inner face of a loading zone cover 15 which surrounds the rotor over an angle range of the rotational movement of the rotor 3 that adjoins the container inlet 9, over which (angle range) a flushing and then preloading of the containers 2 with a suitable inert gas, for example with $CO_2$ gas, takes place. In order to ensure that the entire inner face of the loading zone cover 15 is treated or cleaned, the spray nozzle assembly 13 is designed to dispense a broad fan-shaped or partially spherical jet bundle. Via a line 16 which passes through the filling element 4 or the housing 4.1 thereof and which is formed at 16.1 for example as a channel in the housing 4.1, the spray nozzle assembly 13 is connected to a control valve assembly 17 which is provided on the rotor 3 and via which the spray nozzle assembly can be fed in a controlled manner with at least three different types of a preferably liquid cleaning and/or disinfecting medium, for example with lye, acid and fresh water. The treatment and cleaning media are fed to the control valve assembly 17 via separate lines 18 provided on the rotor 3, via a rotary connection 19 configured for example as a rotary distributor and via separate external lines 20. The cleaning of the loading zone cover 15, which consists substantially of an upper annular wall section 15.1 that is arranged above the movement path of the filling elements 4, of a partially annular vertical wall section 15.2 that adjoins the upper wall section 15.1 and ends with its lower edge considerably below the container carrier 5 and of panels 15.3, takes place during a cleaning mode of the filling machine, for example during the CIP cleaning of the machine while the rotor 3 is rotating. Specifically, the cleaning takes place in such a way that, when the spray nozzle assembly 13 is located in the angle range (spray angle) of the rotational movement of the rotor 3 that is formed by the loading zone cover 15, the cleaning fluid of a first type (e.g. lye or acid or cleaning foam) is delivered onto the inner face of the loading zone cover 15 in a manner controlled by the control valve device 17. During the next revolution of the rotor 3, the delivery of the treatment fluid of a second type (for example acid or lye or cleaning foam) then takes place once again only in the spray angle range, and during the subsequent revolution of the rotor 3 the treatment fluid of the third type, for example water, is delivered.

In principle, it is also possible that at least two revolutions of the rotor 3 are used for delivering the treatment fluid of each type. It is also possible to provide, instead of just one spray nozzle assembly 13, a plurality of such assemblies on the rotor 3 or on the filling elements 4, preferably also with a different orientation of the spray nozzles so as thus reliably to treat in a particularly intensive manner the entire inner face of the loading zone cover 15. Each spray nozzle assembly 13 is then preferably assigned a separate, individually controllable control valve assembly 17. In order to control the at least one spray nozzle assembly 13 as a function of the rotary position of the rotor 3, use is made of those devices which are also used to actuate the filling elements 4 during the normal filling mode as a function of the rotary position of the rotor 3, namely the central control device 21 (computer) and the means (sensors) which cooperate with said device and which detect the rotary position of the rotor 3. Therefore no additional control device is required in order to actuate the at least one spray nozzle assembly 13 in such a way that cleaning fluid is delivered only within the spray angle of the rotational movement of the rotor 3.

It has been assumed above that the at least one spray nozzle assembly 13 is provided on a filling element 4 or on the outer side of the housing 4.1 of the filling element. In principle, it is also possible to provide the spray nozzle assembly 13 between two filling elements 4 of the filling element assembly formed by the plurality of filling elements, said two filling elements following one another on the circumference of the rotor 3, namely such that the spray nozzle assembly 13 protrudes somewhat beyond the outer face of said filling elements. The line 16 is then passed radially outwards through a gap between the two filling elements. This arrangement is possible even when the filling elements 4 of the filling machine 1 are provided extremely closely next to one another on the rotor 3, as is generally the case in high-output filling machines for filling beverages, in particular for filling beer into bottles 2. If a plurality of spray nozzle assemblies 13 are used, these are then each arranged in the same way between two adjacent filling elements 4 and the associated line 16 is passed radially outwards through the gap between said filling elements.

Of course, it is also possible to combine the described ways of positioning the spray nozzle assemblies.

Figure 3:
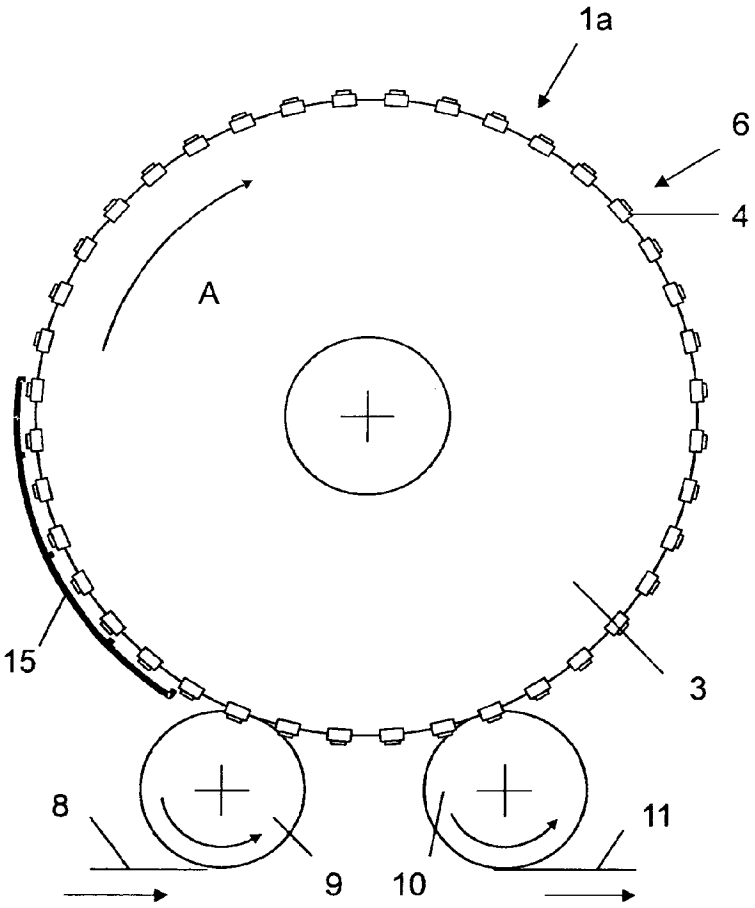
FIGS. 3 and 4 show views like FIGS. 1 and 2 for a different embodiment of the invention.

FIG. 3 shows as a further embodiment a filling machine 1*a* which differs from the filling machine 1 only by the way in which the treatment fluids are fed in a controlled manner to the at least one spray nozzle assembly. In general, also in the filling machine 1*a*, the delivery of the respective cleaning fluid onto the inner face of the loading zone cover 15 during the cleaning mode, i.e. during the CIP cleaning, takes place only within the spray angle, i.e. over the angle range of the rotational movement in which the respective spray nozzle assembly 13 is moving past said cover, and specifically in a manner controlled by means of a control valve 22 which is provided in the line 23 that leads to the spray nozzle assembly 13 and thus corresponds to the line 16. The line 23 is connected via a shut-off valve 24 to a line 25 which during the CIP cleaning of the filling machine 1*a* carries the respective cleaning fluid (lye or acid, cleaning foam or fresh water) under pressure and is used for supplying or diverting the cleaning fluid. The spray nozzle assembly 13 is provided for example once again on the housing of the filling element 4 in question, wherein the line 23 or a channel 23.1 forming the continuation of said line is formed inside the housing 4.1 of the filling element 4, or else the spray nozzle assembly 13 is provided between two filling elements 4 which follow one another on the circumference of the rotor 3. The line 23 is then passed radially outwards through a gap between said filling elements. If a plurality of spray nozzle assemblies 13 are provided, preferably each of said spray nozzle assemblies can be connected to the line 25 in a manner controlled by a separate control valve 22.

Figure 4:
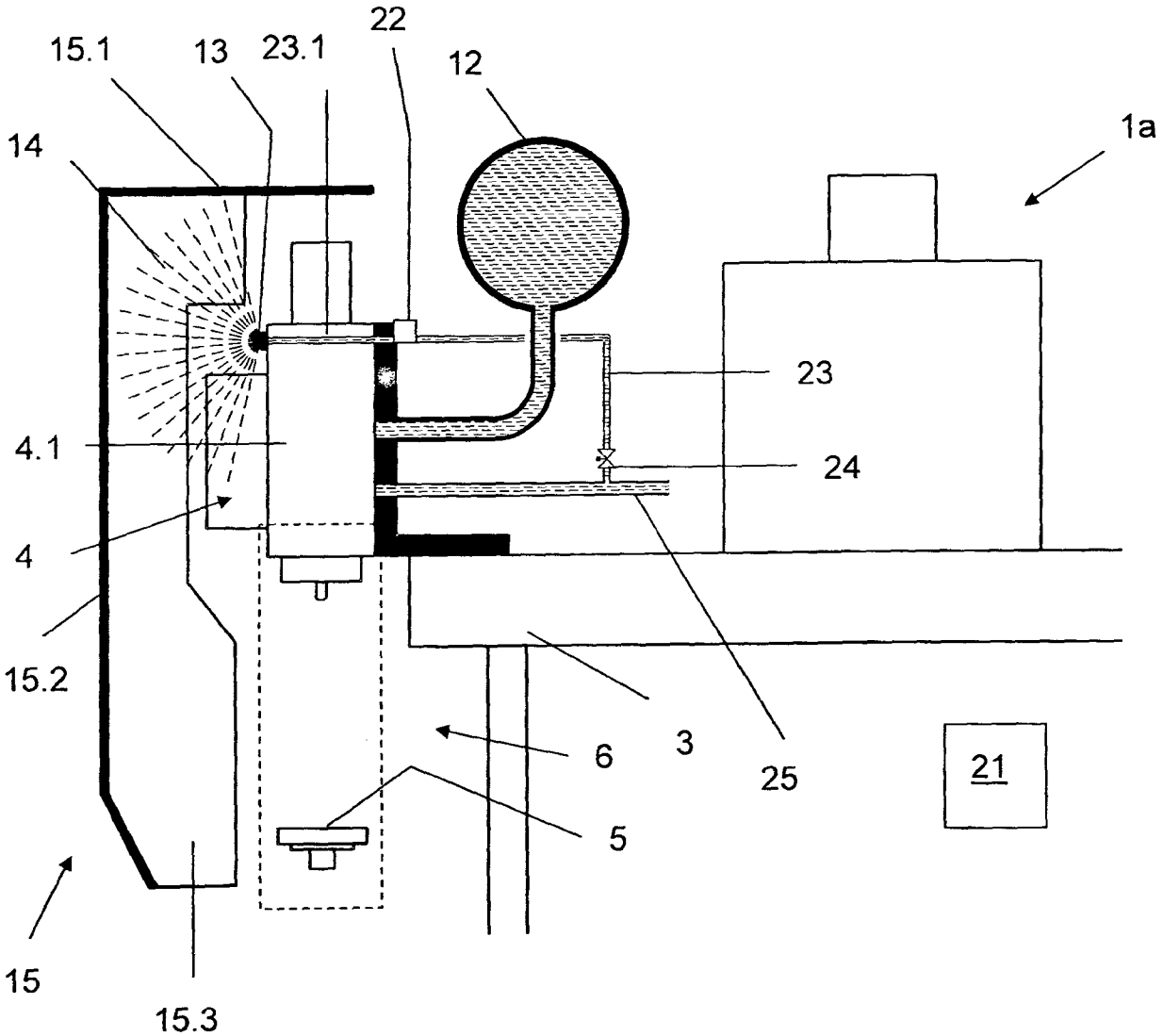

Particularly when the at least one spray nozzle assembly 13 is provided on the outer face of the housing 4.1 of a filling element 4, it is possible to provide vertical separating walls or separating panels 26 between the filling positions 6 formed by said filling elements and the container carriers 5, as indicated by a broken line in FIG. 4, in order thus to shield the individual filling positions from one another, and specifically in particular also from shards of bottles that burst during the preloading and/or pressure filling and/or from splashes of filling material.

Within the spray angle of the rotational movement of the rotor 3, during the CIP cleaning, in each case the treatment fluid that is also used specifically during the CIP cleaning is delivered via the at least one spray nozzle assembly 13 in a manner controlled by the control valve 22. The line 25 carries the respective treatment fluid for example at a pressure of 3 to 3.5 bar.

Figure 5:
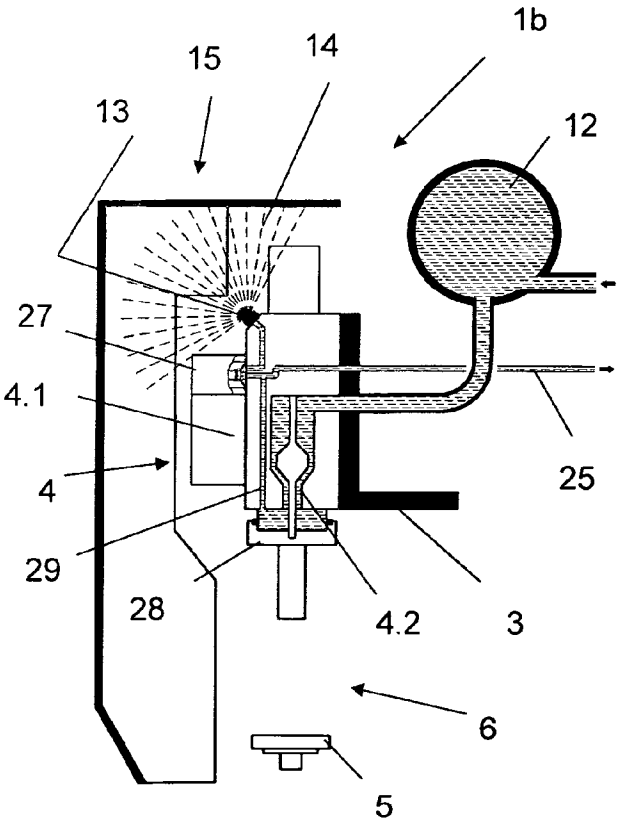
FIG. 5 shows a view similar to FIG. 2 when treating the loading zone cover during a CIP cleaning of the filling machine.

FIG. 5 shows as a further embodiment a filling element 4 of a filling machine 1*b*, said filling element being provided with the spray nozzle assembly 13. The filling machine 1*b* differs from the filling machine 1*a* essentially only in that a separate and individually controllable control valve 27 for controlling the spray nozzle assembly 13 is provided on the filling element 4 in addition to the other valves that control said filling element during the normal filling process. FIG. 5 shows the filling element 4 in its state that allows CIP cleaning, in which the filling element 4 is closed by a flushing cap 28 on its underside, i.e. in the region of the dispensing opening of the liquid channel 4.2 which is located there and via which the bottles 2 are filled in the filling mode. Proceeding from the ring bowl 12, therefore, a flow path that leads to the line 25 is obtained through the liquid channel 4.2 of the filling element 4, through the associated flushing cap 28 and through a channel 29 that is formed in the respective filling element, the cleaning fluid used for the CIP cleaning flowing through said flow path. The control valve 27 is connected by its inlet to the line 25 which serves for returning the cleaning fluid, so that the spray nozzle assembly 13 is in each case supplied with the cleaning fluid from the channel 29 or the line 25 via the open control valve 27 within the spray angle. In the embodiment shown in FIG. 5, the spray nozzle assembly 13 is provided on an angled face at the top of the housing 4.1, namely in such a way that the jet bundle 14 delivered by the spray nozzle assembly 13 is directed more intensely onto the upper region of the inner face of the loading zone cover 15. In this embodiment, too, it is once again possible to provide separating walls or separating panels 26 between the individual filling elements 4, which separating walls or separating panels separate the filling positions 6 from one another.

The invention has been described above on the basis of examples of embodiments. It will be understood that numerous changes and modifications are possible without thereby departing from the inventive concept on which the invention is based.

LIST OF REFERENCES

1, 1*a*, 1*b* filling machine
2 container
3 rotor
4 filling element
5 container carrier
6 filling position
8 conveyor
9 container inlet
10 container outlet
11 conveyor
12 ring bowl
13 spray nozzle or spray nozzle assembly
14 jet bundle
15 loading zone cover
16 line
17 control valve assembly
18 line
19 rotary distributor
20 line
21 control device or control computer
22 control valve
23 line
24 shut-off valve
25 line
26 separating panel
27 control valve
28 flushing cap
A direction of rotation of the rotor 3
MA vertical machine axis

The invention claimed is:

1. A method for treating a loading-zone cover that is disposed adjacent to a rotor of a filling machine that has a plurality of filling elements, each of which is housed within a filling-element housing, wherein, during operation, said rotor rotates about a machine axis of said filling machine, wherein while rotating about said machine axis, said rotor moves relative to said loading-zone cover, thereby bring each of said filling elements, each of which is housed within its filling-element housing, past said loading-zone cover, said method comprising treating said loading-zone cover while carrying out CIP treatment of said filling machine, wherein carrying out CIP treatment comprises cleaning all of said filling elements of said filling machine, and wherein treating said loading-zone cover comprises, concurrently with cleaning all of said filling elements of said filling machine, rotating said rotor so that each filling element from said plurality of filling elements transitions from a first state to a second state, wherein in said first state, there is no loading-zone cover in a radial direction relative to said filling element, and in said second state, there is a loading-zone cover in a radial direction relative to said filling element, while said filling element is in said second state, delivering a spray of medium toward said loading-zone cover with a spray-nozzle that is provided on said rotor, continuing to rotate said rotor so that said filling element, which is itself in the process of being cleaned, transitions from said second state back to said first state, wherein, in one complete rotation of said rotor, said filling element, which is itself in the process of being cleaned as a result of concurrent CIP treatment of said filling machine, transitions from said second state to said first state no more than once, wherein, in one complete rotation of said rotor, during at least a portion of which CIP treatment of said filling machine, and hence said filling element as well as all other filling elements on said filling machine takes place, said filling element transitions from said first state to said second state no more than once, wherein treating said loading-zone cover comprises a procedure selected from the group consisting of cleaning said loading-zone cover and sterilizing said loading-zone cover, and wherein said medium is selected from the group consisting of a treatment medium and a cleaning medium.

2. The method of claim 1, wherein delivering said spray of medium toward said loading-zone cover comprises directing said spray of medium toward said loading-zone cover while said rotor rotates.

3. The method of claim 1, wherein said rotor rotates through an angular range, wherein delivering said spray of medium toward said loading-zone cover comprises delivering said medium while said spray-nozzle is moving within said angular range, wherein, while said spray-nozzle is moving within said angular range, said spray-nozzle structure moves past said loading-zone cover.

4. The method of claim 1, wherein delivering said spray of medium toward said loading-zone cover comprises using a control valve to control said delivery, wherein said control valve is disposed to control fluid communication between said spray-nozzle structure and a line formed at least partially in said filling-element housing, wherein said line carries said medium during said CIP treatment of said filling machine.

5. The method of claim 1, wherein delivering said spray of medium toward said loading-zone cover comprises delivering a first medium to said loading-zone cover during a first revolution of said rotor, and delivering a second medium to said loading-zone cover during a second revolution of said rotor, wherein said first revolution and said second revolution occur at different times, and wherein said first medium is different from said second medium.

6. The method of claim 1, wherein delivering said spray of medium toward said loading-zone cover with a spray-nozzle that is provided on said rotor comprises delivering said spray of medium toward said loading-zone cover with a spray-nozzle that is provided on a region of an outer face of said filling-element housing, wherein said outer face faces away from said machine axis.

7. The method of claim 1, wherein delivering said spray of medium toward said loading-zone cover with a spray-nozzle that is provided on said rotor comprises, during said CIP treatment, connecting said spray-nozzle to a channel that is formed in said filling-element housing, wherein said channel carries said medium during said CIP treatment of said filling machine, wherein said channel is-selected from the group consisting of a gas channel and a liquid channel.

8. The method of claim 1, wherein delivering a spray of medium toward said loading-zone cover with a spray-nozzle that is provided on said rotor comprises delivering said medium from a plurality of treatment heads formed on said rotor, said treatment heads being disposed along a periphery of said rotor, each of said treatment heads having a nozzle of said spray-nozzle.

9. The method of claim 8, wherein delivering a spray of medium toward said loading-zone cover with a spray-nozzle that is provided on said rotor comprises delivering said medium along a radial direction, wherein said radial direction is a direction away from said machine axis.

10. The method of claim 1, wherein delivering said spray of medium toward said loading-zone cover with a spray-nozzle comprises delivering said spray from said filling-element housing that houses a filling element of said filling machine, wherein said spray-nozzle structure is arranged on said filling-element housing.

11. The method of claim 1, wherein delivering a spray of medium toward said loading-zone cover with a spray-nozzle comprises delivering said spray from between said filling-element housing and an additional filling-element housing that encloses an additional filling element, wherein said filling-element housing and said additional filling-element housing are adjacent to each other along a circumference of said rotor.

12. The method of claim 1, further comprising controlling a supply of said medium, wherein controlling said supply of said medium comprises using a controlled-fluid connection that is formed at least in part within said filling-element housing on said rotor, wherein said spray-nozzle is connected to said controlled fluid-connection.

13. The method of claim 1, wherein delivering said spray medium comprises using a control valve that is in a controlled fluid connection, wherein said control valve is arranged on a said rotor.

14. The method of claim 1, wherein delivering said spray medium comprises using a control valve that is in a controlled fluid connection, wherein said control valve is arranged in said filling-element housing.

15. The method of claim 1, wherein delivering said spray medium comprises using a control valve that is in a controlled fluid connection, wherein said control valve is disposed in said filling-element housing for controlling a channel formed in said filling-element housing.

16. The method of claim 1, wherein delivering said spray medium comprises using a control device configured for controlling dispensing of said medium to said spray-nozzle.

17. The method of claim 1, wherein delivering said spray medium comprises using a control device to connect said spray-nozzle to a first line that carries a first medium, and using said control device to disconnect said spray-nozzle from said first line and to connect said spray-nozzle to a second line that carries a second medium.

18. The method of claim 1, wherein delivering said spray of medium toward said loading-zone cover comprises using a control valve to control said delivery, wherein said control valve is disposed to be in fluid communication between said spray-nozzle and a line formed at least partially in said filling-element housing, wherein said line carries said medium during said CIP treatment of said filling machine, wherein using said control valve comprises opening said control valve while said spray-nozzle is being moved past said loading-zone cover and closing said control valve when said spray-nozzle has passed said loading-zone cover.

19. An apparatus for treating a loading-zone cover that is disposed adjacent to a rotor of a filling machine that, during operation, moves relative to said loading-zone cover, said apparatus comprising a plurality of filling elements, wherein each of said filling elements comprises a filling-element housing that encloses said filling element, and a spray-nozzle, wherein each of said filling-element housings comprises first and second channels formed therein, said first channel forming an opening for controlled dispensing of filling material into a container and said second channel being connected to a source of medium for use during CIP treatment of said filling machine, wherein said spray-nozzle is disposed on an outer face of said filling-element housing, wherein said spray-nozzle is connected to said second channel, thereby enabling at least some medium provided to said filling machine during said CIP treatment thereof to be delivered in a spray toward said loading-zone cover, wherein said medium is selected from the group consisting of a cleaning medium and a disinfecting medium, wherein said second channel is a channel selected from the group consisting of a cleaning channel and a disinfecting channel, and wherein treating said loading-zone cover comprises a procedure selected from the group consisting of cleaning said loading-zone cover and sterilizing said loading-zone cover.

20. The apparatus of claim 19, further comprising additional filling-element housings each of which has outer face on which is disposed a corresponding spray-nozzle, wherein each of said additional element housings comprises first and second channels formed therein, each of said first channels forming opening for controlled dispensing of filling material into a corresponding container, and each of said second channels being connected to a source of medium for use during said CIP treatment of said filling machine.

21. The apparatus of claim 19, wherein said loading zone cover extends along an angular range of said rotor, said angular range being less than 360 degrees, wherein said loading zone cover divides a container's path into a first section, in which said container is shielded by said loading zone cover, and a second section, in which said container is not shielded by said loading zone cover, wherein said first and section sections together span 360 degrees.

22. The apparatus of claim 20, wherein said additional filling-element housings each enclose a separate filling element.

23. The method of claim 1, wherein delivering a spray of medium occurs when said rotor carries said filling element through a region in which containers are pre-loaded to filling pressure.

24. The method of claim 1, wherein delivering a spray of medium comprises delivering said spray towards transverse ribs of said loading-zone cover.

* * * * *